United States Patent [19]

Rump

[11] Patent Number: 4,773,882

[45] Date of Patent: Sep. 27, 1988

[54] HYDRAULIC STEERING ASSEMBLY FOR OUTBOARD ENGINES

[75] Inventor: Martin Rump, North Vancouver, Canada

[73] Assignee: Teleflex Incorporated, Limerick, Pa.

[21] Appl. No.: 587,140

[22] Filed: Mar. 7, 1984

Related U.S. Application Data

[63] Continuation of Ser. No. 456,227, Jan. 7, 1983, abandoned, which is a continuation of Ser. No. 152,791, May 23, 1980, abandoned.

[51] Int. Cl.[4] ..... B63H 21/26

[52] U.S. Cl. ..... 440/61

[58] Field of Search ..... 74/469, 480 B, 484 R, 74/486, 487, 501 R; 91/196, 210, 216 R, 216 B, 217, 462; 114/150, 144 R; 440/53, 61-65; 92/66

[56] References Cited

U.S. PATENT DOCUMENTS

| | | | |
|---|---|---|---|
| 2,787,235 | 4/1957 | Schroeder | 114/150 |
| 2,939,417 | 6/1960 | Hammock, Sr. | 114/150 |
| 3,105,529 | 10/1963 | Bargdill et al. | 92/66 |
| 3,121,415 | 2/1964 | Anderson et al. | 440/59 |
| 3,148,657 | 9/1964 | Horning | 114/150 |
| 3,180,096 | 4/1965 | Peterson | 440/61 X |
| 3,181,491 | 5/1965 | Dunning | 114/150 |
| 3,631,833 | 1/1972 | Shimanckes | 440/62 X |
| 3,654,889 | 4/1972 | Bergstedt | 440/61 |
| 3,772,966 | 11/1973 | Mills | 92/66 |
| 4,041,889 | 8/1977 | Blauchard | 114/144 R |
| 4,054,102 | 10/1977 | Borst et al. | 440/62 |
| 4,160,410 | 7/1979 | Fichter | 91/462 X |
| 4,373,920 | 2/1983 | Hall et al. | 440/61 X |

*Primary Examiner*—Sherman D. Basinger

*Attorney, Agent, or Firm*—Reising, Ethington, Barnard, Perry & Milton

[57] ABSTRACT

A hydraulic steering assembly to be secured to a tiller arm of a variety of outboard propulsion units for a boat so as to rotate a propulsion unit about a steering axis. The assembly comprises a hydraulic cylinder having a hydraulically actuated rod member extending therefrom and being rotatably secured to the tiller arm of an outboard propulsion unit about an axis of rotation parallel to the steering axis. The hydraulic cylinder also includes a pivotal connection for attachment to the boat to define a pivot axis generally parallel to the steering axis and nonrotatable about the steering axis. The force exerted by actuation of the hydraulic cylinder against the pivotal connection rotates the outboard propulsion unit about the steering axis.

31 Claims, 5 Drawing Sheets

HYDRAULIC STEERING ASSEMBLY FOR OUTBOARD ENGINES

This is a continuation of application Ser. No. 456,227 filed Jan. 7, 1983 and now abandoned which is a continuation of Ser. No. 152,791 filed 5/23/80 and now abandoned.

BACKGROUND OF THE INVENTION (1) Field of the Invention

The subject invention relates to a hydraulic steering assembly to be attached to the tiller arm of an outboard propulsion unit for a boat so as to rotate the propulsion unit about a steering axis.

(2) Description of the Prior Art

Prior art steering assemblies for outboard propulsion units of boats have rotated the propulsion unit by means of push-pull mechanical cables or via hydraulic actuation. Introduction of higher horsepower engines have resulted in a demand for more reliable hydraulic steering systems. These systems have typically included cylinders which protrude an undesirable amount to one side of the engine. One type of prior art hydraulic cylinder is mounted in a manner to require the rod of the cylinder to be secured to the tiller arm of the engine by means of a link. This assembly is often installed incorrectly resulting in accidents. Also, it is desirable to keep the cylinder as short as possible. This has been accomplished in prior art steering assemblies by including only one piston rod in the cylinder. The result is an imbalance in the oil supply required by the cylinder. Additional problems have resulted where the steering assemblies require specific adaptations of the propulsion unit to accommodate the assembly. Thus, these assemblies cannot be adapted for all engine models.

SUMMARY OF THE INVENTION

The instant invention provides a hydraulic steering assembly to be secured to a tiller arm of a variety of outboard propulsion units for a boat so as to rotate a propulsion unit about a steering axis. The assembly comprises a hydraulic cylinder having a hydraulically actuated rod member extending therefrom. The hydraulic cylinder includes securing means for rotatably securing the hydraulic cylinder to the tiller arm of an outboard propulsion unit. The securing means has an axis of rotation parallel to the steering axis. The assembly also includes pivot means adapted for attachment to the boat including a pivotal connection to the rod member to define a pivot axis. The pivot axis is generally parallel to the steering axis and nonrotatable about the steering axis. Force exerted by actuation of the hydraulic cylinder against the pivot means rotates the outboard propulsion unit about the steering axis.

PRIOR ART STATEMENT

Examples of prior art steering systems are U.S. Pat. Nos. 3,654,889 to Bergstedt issued Apr. 11, 1972 and 4,041,889 to Blanchard issued Aug. 16, 1977. Both patents disclose a hydraulic steering system including a cylinder and piston assembly. The assembly actuates turning and/or tilting rovement of an outboard propulsion unit. Both patents teach a system including a rack and pinion steering mechanism. Neither patent discloses a steering system which is adaptable to most outboard propulsion units in production. Also, neither patent teaches the use of a balanced oil supply within the cylinder assembly to actuate the housed piston.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF PREFERRED EMBODIMENT

Figure 1:
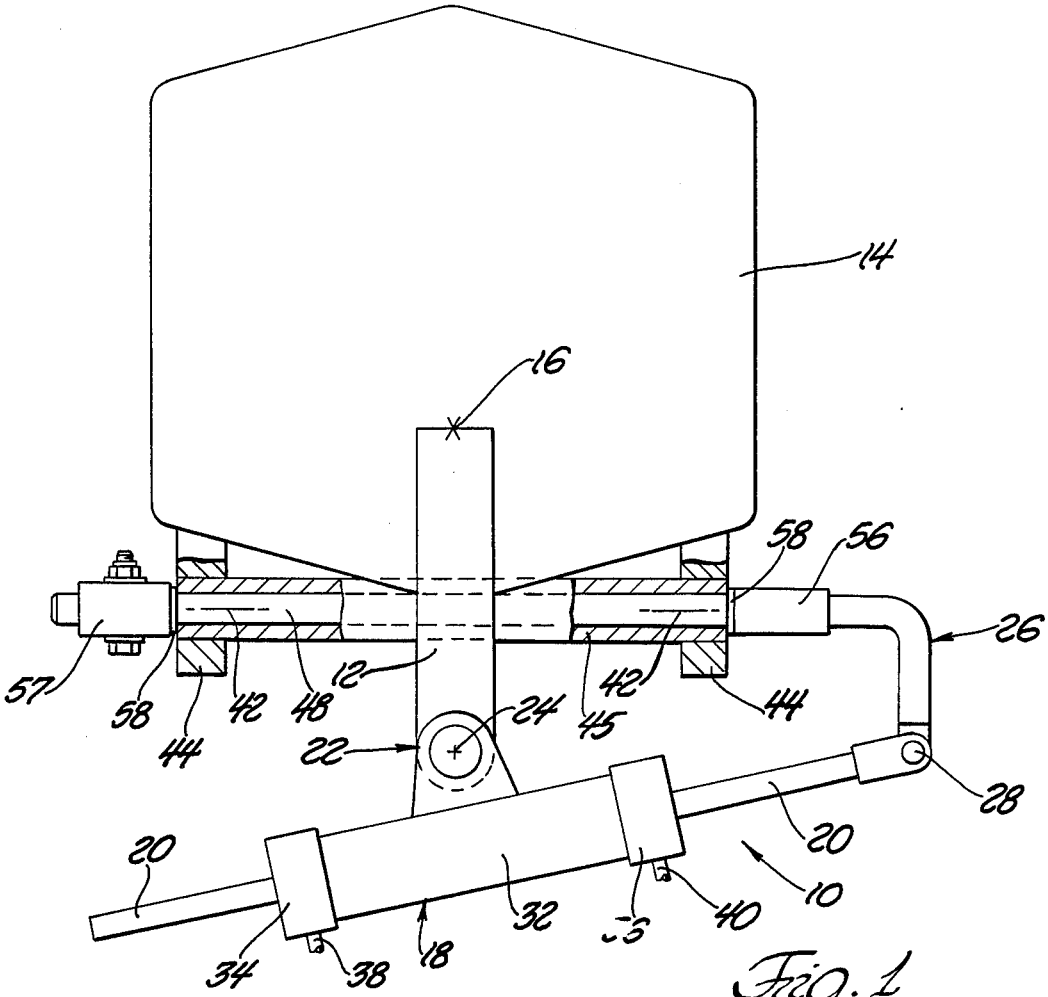
FIG. 1 is a diagrammatic plan view of the steering assembly of the subject invention secured to an outboard propulsion unit with the axis of rotation on the tiller arm.
Figure 3:
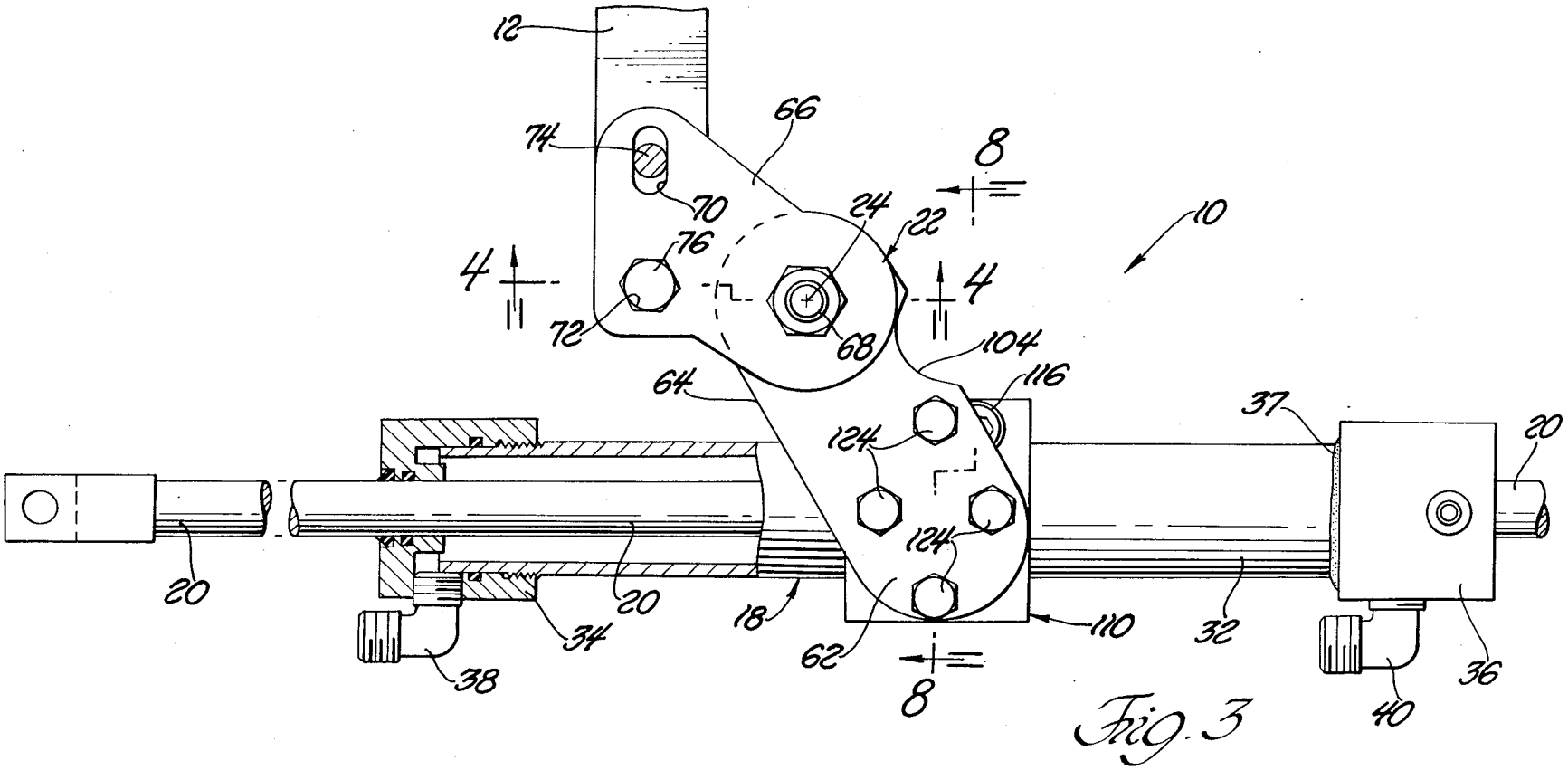
FIG. 3 is a plan view partially broken away and in cross section of the steering assembly secured to the tiller arm of an outboard propulsion unit with the axis of rotation besides the tiller arm.

A hydraulic steering assembly constructed in accordance with the instant invention is generally shown at 10 in FIGS. 1 and 3. The steering assembly 10 is secured to a tiller arm 12 of an outboard propulsion unit 14.

The subject hydraulic steering assembly 10 comprises a hydraulic cylinder generally indicated at 18 having a hydraulically actuated rod member 20 extending therefrom. The hydraulic cylinder 18 includes securing means generally indicated at 22 for rotatably securing the hydraulic cylinder 18 to the tiller arm 12. The securing means 22 has an axis of rotation at 24 parallel to the steering axis 16 of the water drive means of the propulsion unit and is attached directly to the tiller arm 12.

Figure 2:
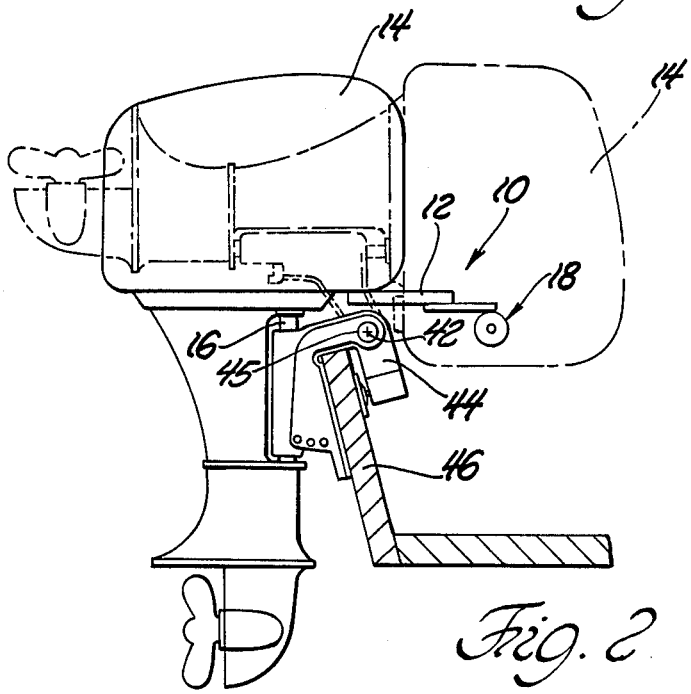
FIG. 2 is a side view of an outboard propulsion unit secured to the splash wall of a boat.

FIG. 2 shows another view of the outboard propulsion unit 14 as it would be mounted on a boat for rotation about a steering axis 16.

Returning to FIG. 1, the steering assembly 10 also comprises a pivot means generally indicated at 26 adapted for attachment to the stationary part of the engine bracket mounted to the boat. The pivot means 26 includes a pivotal connection 28 to the rod member 20 to define a pivot axis generally parallel to the steering axis 16 and nonrotatable about the steering axis 16 so that force exerted by actuation of the hydraulic cylinder 18 against the pivot means 26 rotates the outboard propulsion unit 14 about the steering axis 16. In other words, the cylinder 18 oscillates with the tiller arm, however, the rod 20 is stationary in relation to the engine and is not performing the steering motion.

Figure 5:
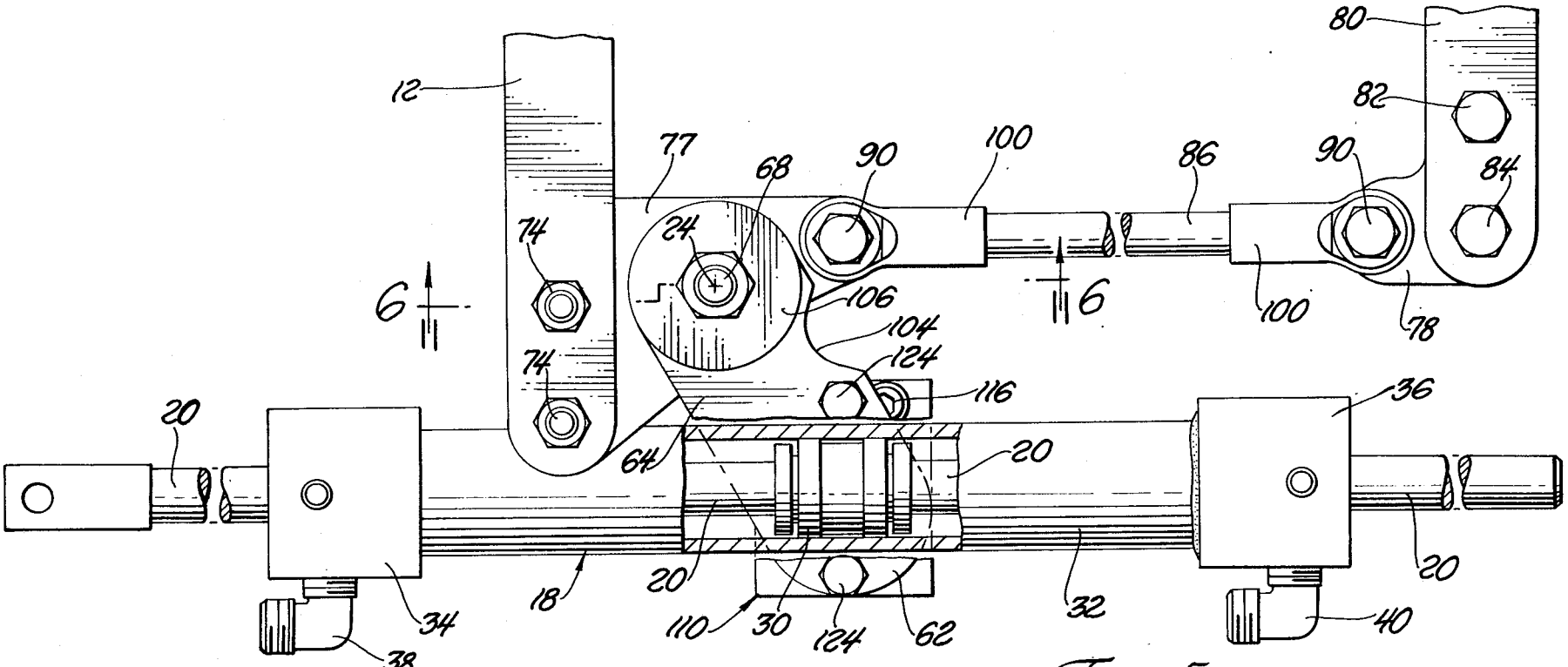
FIG. 5 is a plan view of an alternative embodiment of the subject steering assembly as it would be secured to a boat having two outboard propulsion units.

As shown in FIG. 5, the hydraulic cylinder 18 includes a hydraulic piston 30 slidably supported therein. The rod member 20 extends from opposite sides of the piston 30 and through the opposite ends of the hydraulic cylinder 18. The piston 30 is mounted at an equal distance from the ends of the rod 20. Because the rod extends from the piston through both ends of the cylinder, the respective volumes of fluid entering the cylinder on one side of the piston 30 and exiting on the other side of the piston 30 are equal during movement of the piston. Hence, there is a balanced supply and return of hydraulic fluid used at all times to actuate the piston 30 within the cylinder 18. As shown in FIG. 1, the cylinder 18 can be mounted centrally in relation to the tiller arm 12 and does not protrude excessively to either side of the outboard propulsion unit 14.

The cylinder includes a barrel member 32 and two gland members 34 and 36 secured to the ends thereof. The gland members 34 and 36 are threaded to barrel 32 and are sealed with an appropriate sealing compound. The gland members include coupling means or elbows 38 and 40 for conveying hydraulic fluid. The coupling members 38 and 40 would be connected to hoses leading to a pump driven by a steering wheel of the steering unit of the boat.

Figure 12:
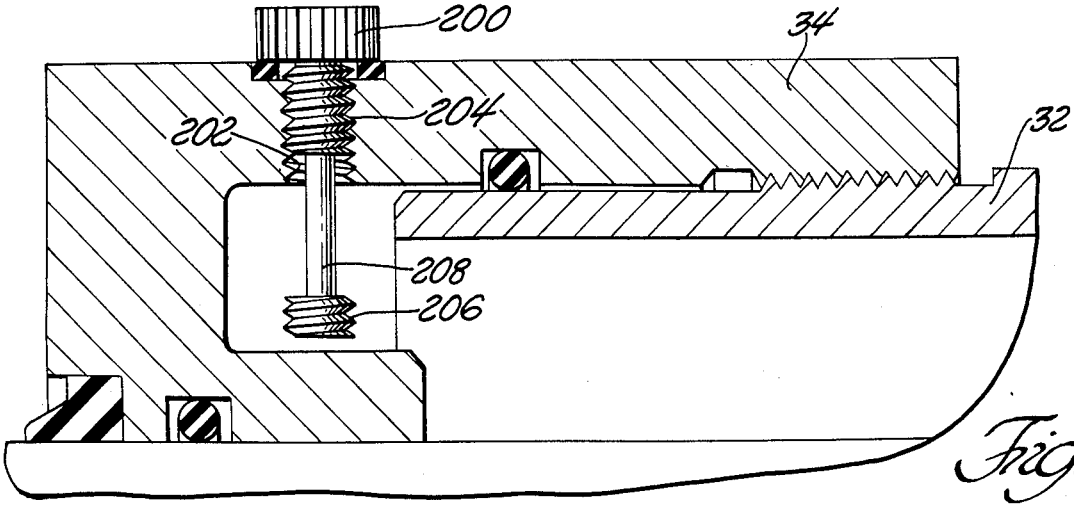
FIG. 12 is an enlarged fragmentary cross-sectional view illustrating an air bleed utilized in the disclosed assembly.

As shown in FIG. 12, the cylinder 18 can include a bleed screw 200 disposed in gland members 34 and 36 for allowing the release of air from within the cylinder. The bleed screw includes a first threaded portion 204 which is received in the threaded passageway 202. The screw 200 includes a second threaded portion 206 separated from the first portion 204 by a portion of reduced diameter 208. The length of the reduced portion 208 is greater than the length of the passageway 202 so that the first threaded portion 204 can be unscrewed to allow bleeding of air. The second threaded portion 206 can engage the passageway 202 so as to prevent the screw 200 from being completely forced from the passageway 202 during bleeding. This prevents accidental loss of the bleed screw during bleeding. To intentionally completely remove the bleed screw 200, the second threaded portion 206 is threaded out the passageway 202.

The travel distance of the piston 30 within the cylinder 18 is equal or greater than the swing distance of the outboard propulsion unit 14 (as shown in FIG. 1) about the steering axis 16 at either port or starboard hardover positions. Therefore, at either hardover position the stops of the propulsion unit 14 limits the extent of movement of the piston 30 within the cylinder 32. In other words, at either hardover position the steering assembly uses the stops of the propulsion unit rather than full extension of the steering unit at which the piston 30 would engage an end of the cylinder. In the situation where a propulsion unit hits an object within the water and is forced into a hardover position, the force exerted is therefore placed upon the engine stops and not upon the stops of the steering unit, thusly saving the steering unit from excessive damage.

As shown in FIGS. 1 and 2, the pivot means 26 includes attachment means for attachment through an opening 42 along a tilt axis in a propulsion unit support structure 44 which is stationarily attached to the boat body. The propulsion unit support structure 44 secures the outboard propulsion unit 14 to the splash wall 46 of a boat. The opening 42 defines a tilt axis for tilting rotation of the propulsion unit 14 about the tilt axis. The tilt axis extends transversely to the steering axis defined at 16 and to the tiller arm 12 so that the propulsion unit may be rotated into and out of the water about the tilt axis without changing the relative position of cylinder 18 as illustrated in FIG. 2.

Figure 7:
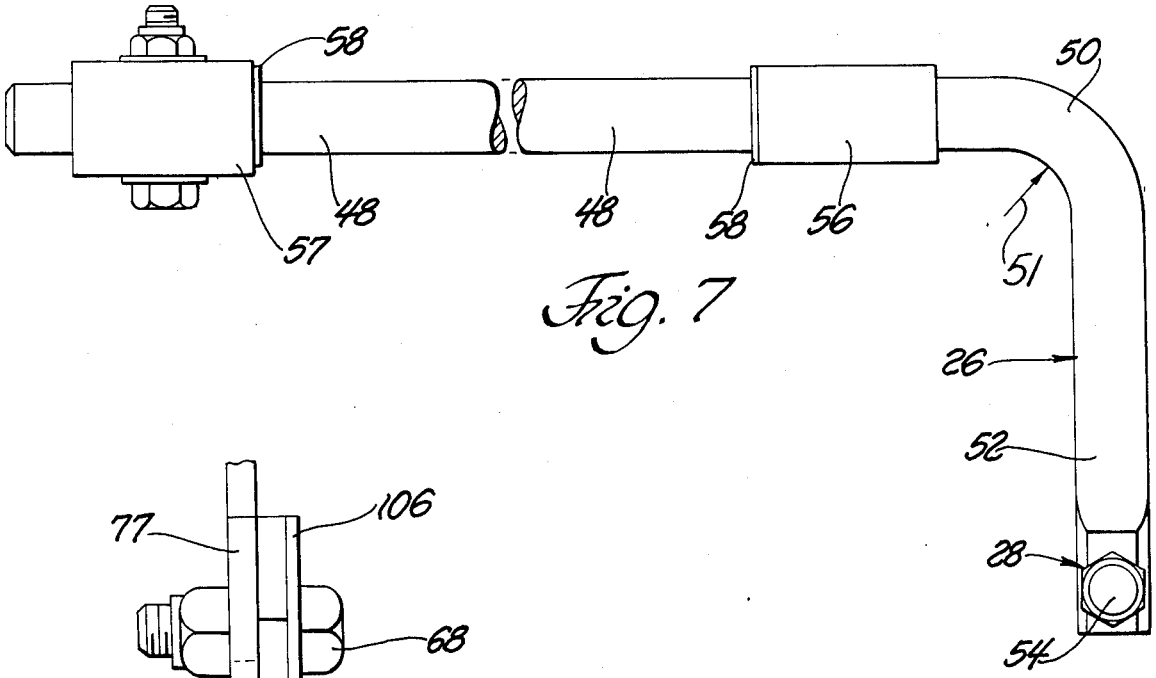
FIG. 7 is a view of the link rod of the pivot means.

As shown in FIG. 7, the pivot means 26 includes an insertion member or link rod having a straight portion 48 for extending through the opening 42 along the tilt axis and rotatable about the tilt axis to allow rotation of the insertion member about the tilt axis. As shown in FIG. 1, the pivotal connection 28 is spaced from and in a nonintersecting relationship to the straight portion 48. The link rod 26 is fixed in the area of the straight portion 48 at the tilt tube center 42 of the tilt tube 45 so that the steering is not affected during the trimming movements of the engine. If the link rod 26 with the straight portion 48 is fixed at any other position, the tiller arm 12 would swing sideward when the engine 14 is trimmed. The insertion member 26 includes a transverse portion 52 extending between the straight portion 48 and pivotal connection 28. The insertion member is rotatably secured to the rod member 20 by bolt 54. Spacer sleeve 56 and collar 57 secure the propulsion unit support structure therebetween. Washers 58 are situated between the tilt tube 45 and spacer sleeve 56 and collar 57. In the preferred embodiment the transverse portion 52 of the link rod 26 is separated from the straight portion 48 by an arcuate portion 50. The minimum radius 51 must be about 2.5 times the thickness of the link rod to avoid excessive local yielding or rupture.

Figure 11:
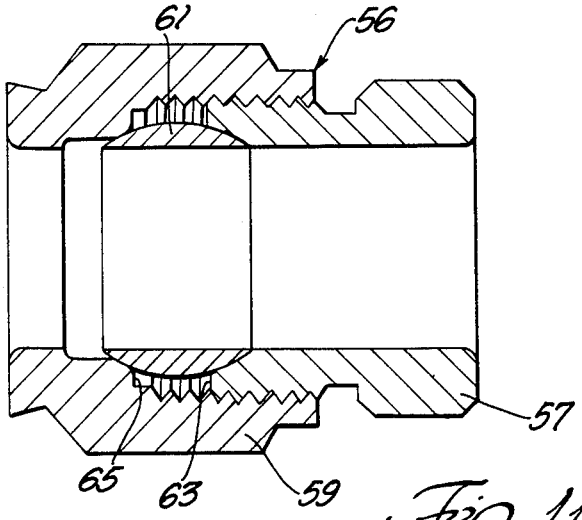
FIG. 11 is an enlarged cross-sectional view of a sleeve used in the disclosed assembly.

As shown in FIG. 11, the spacer sleeve 56 is a compression fitting and can be made out of nut member 59, a bushing 57 and a sleeve 61. Member 57 threadedly engages member 59. In doing so, sleeve 61 is compressed between arcuate portions 63 and 65 and the enclosed link rod preventing the link rod from shifting inside the tilt tube 45. The sleeve 61 can be made from nylon, brass, or the like.

Preferably, the axis of the cylinder 18 is in the same horizontal plane as the tilt tube axis so that the cylinder axis remains in the same plane as the tilt axis in the hardover positions. This is the most mechanically efficient positioning of the hydraulic cylinder in relation to the tilt axis.

FIG. 3 shows the hydraulic cylinder in a neutral position of actuation. In the preferred embodiment, the securing means 22 includes a cylinder plate 62 having a first edge 64 extending in a direction away from the tiller arm 12 and nonparallel in relation to the tiller arm 12 when the cylinder 18 is in the neutral position as shown in FIG. 3. This positioning of the cylinder plate 62 in relation to the tiller arm 12 prevents contact of the cylinder plate 62 with the tiller arm 12 when the steering assembly is in the starboard hardover position. In other words, the cylinder plate 62 rotates clockwise about the axis defined at 24 in steering movement toward the hardover starboard position. The cylinder plate 62 rotates clockwise about the axis 24 and approaches the tiller arm 12. The angle of the edge 64 of the cylinder plate 62 allows clearance of the tiller arm with the cylinder plate in the hardover position. Again, this allows the use of the engine stop in both hardover positions rather than the steering stops. Therefore, in an overload situation where the engine is driven into a hardover position the construction of the cylinder plate 62 is adapted to prevent damage to the steering assembly.

The securing means generally indicated at 22 also includes a tiller plate 66 adapted for fixed attachment to the tiller arm 12. Bolt 68 interconnects the cylinder plate 62 and tiller plate 66 for rotation relative to one another about the axis of rotation defined at 24.

Figure 6:
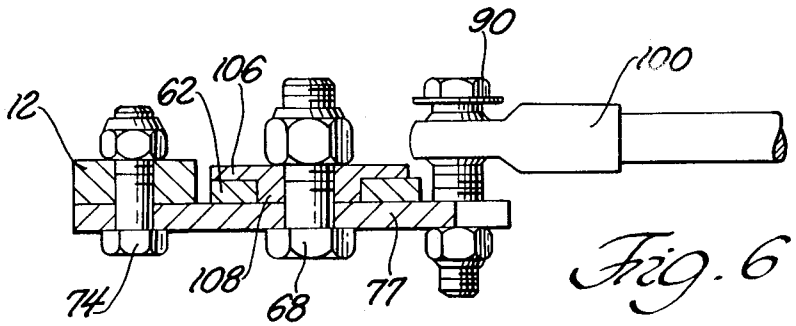
FIG. 6 is a cross-sectional view taken along line 6—6 of FIG. 5.

As shown in FIG. 3, the tiller plate 66 includes at least two holes 70 and 72 for receiving fastening means 74 and 76 for attachment to the tiller arm 12. As shown in cross section in FIG. 4, the cylinder plate 62 is rotatably secured to the tiller plate 66 by bolt 68. The cylinder plate 62 is secured on the same side of the tiller plate 66 as the tiller arm 12 but may be reversed as illustrated in FIG. 6.

As illustrated in FIG. 3, the hole 70 in the tiller plate 66 is elongated, i.e., a slot or oval. The elongated hole 70 allows the tiller plate to be secured on either side of the tiller arm 12 to move the plate a distance equal to the differences between the location of tiller arms in relation to tilt axes of presently manufactured outboard propulsion units.

Figure 10:
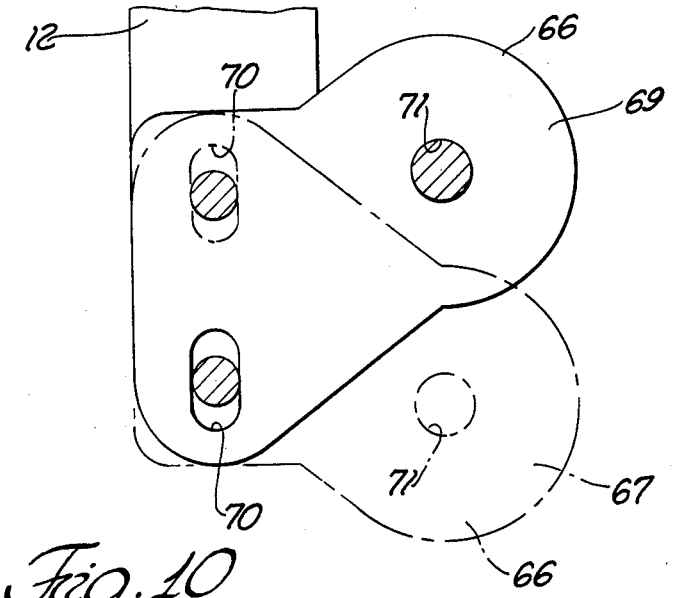
FIG. 10 is a view showing alternative attachments and location relative to the tiller arm.

As shown in FIG. 10, in order to maintain the proper steering geometry, the tiller plate 66 is in position 67 when the plate is mounted above or below the tiller arm 12 or the tiller plate 66 is in position 69 when it is mounted above or below the tiller arm. The varying positioning of bolt hole 71 allows the cylinder assembly to be mounted almost parallel to the tilt tube 45 in accordance with the specifications of all motors so that the forces created by cylinder 18 act perpendicularly on tiller arm 12. Also, the use of the face-to-face connection of the tiller plate and cylinder plate as a securing means for the cylinder 18 to the tiller arm 12 provides maximal support for the steering assembly.

FIG. 5 shows an additional embodiment of the subject assembly including a second tiller plate 78 adapted for attachment to a second tiller arm 80 of a second outboard propulsion unit. An alternative configuration of the tiller plate is shown at 77. In this embodiment the tiller plate 77 is shown to be mounted on the tiller arm 12. This arrangement is also shown in cross section in FIG. 6. Again, cylinder plate 62 and tiller arm 12 are mounted on the same side of the tiller plate 77. Coupling means directly couples the tiller plates 77 and 78 together for coordinating steering movement between the two outboard propulsion units whereby the forces are transferred directly between the tiller arms. The coupling means includes a tie rod 86. The tiller plates 77 and 78 have bores therein for receiving bolt means 90 for rotatably supporting spherical rod ends 100 of the tie rod 86. Forces resulting from movement of the propulsion units are therefore transferred directly between the plates 77 and 78. Therefore, these steering forces are transferred directly between the tiller arms 12 and 80 and not to the cylinder 18. The result is that the steering assembly only encounters steering forces which equal the difference between the forces exerted on each propulsion unit. In other words, one propulsion unit may have a negative steering force while the other has a plus steering force. Thus, the steering load exerted on the steering assembly is the difference of loads between the port and starboard engines.

As shown in FIG. 5, the cylinder includes a second edge spaced from the first edge 64 which includes a notch 104 therein for allowing clearance of the spherical rod end 100 which secures the tie rod 86 to the tiller plate 77. This adaptation allows for clearance of the spherical rod end 100 by the cylinder plate 62 when the steering assembly is in the hardover port position. Again, this increases the rotational distance of the steering assembly which allows the assembly to use the engine stops rather than the steering assembly stops.

Figure 4:
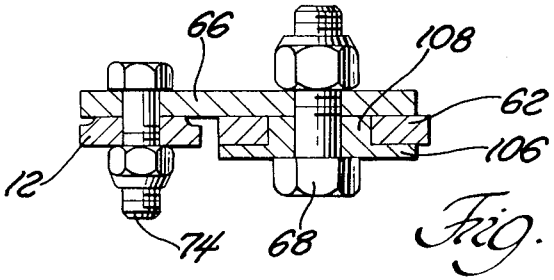
FIG. 4 is a cross-sectional view taken along line 4—4 of FIG. 3.

As shown in FIGS. 4 and 6, the securing means includes a bushing 106 having a bore therethrough for receiving the bolt 68. The bushing 106 includes a collar portion 108 and the cylinder plate 62 receives the outer diameter of the collar 108 with the cylindrical length longer than the thickness of cylinder plate 62. Therefore, the cylinder plate 62 is rotatably secured between the bushing 106 and the tiller plate 77 for rotation therebetween about the axis of rotation.

Figure 8:
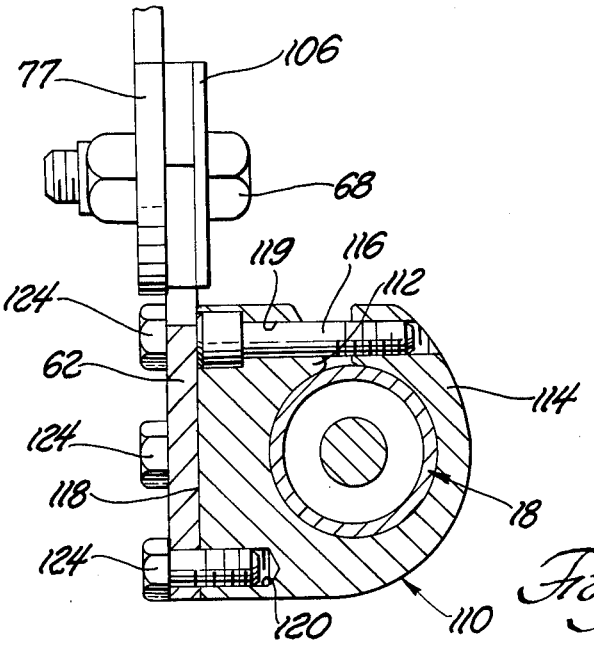
FIG. 8 is a side view of the clamp member securing the hydraulic cylinder therewithin.

FIG. 8 shows the cylinder plate 62 secured to the cylinder 18 via clamp member 110. The clamp member 110 is of a C-shaped construction having the first and second legs or clamping portions 112 and 114 respectively. The legs have two bores 119 therethrough for receiving fastening means in the form of the clamping bolts 116. The bolts 116 are threaded to the clamping portion 114 and the bore 119 is countersunk to receive the heads of the bolts 116.

The first leg 112 of the C-shaped construction includes a flat surface 118 having four threaded bores 120 therein. The cylinder plate 62 has bores therein corresponding to the bores 120 in the first leg 112 for receiving bolts 124 which fixedly secure the cylinder plate 62 to the C-shaped construction 110.

Figure 9:
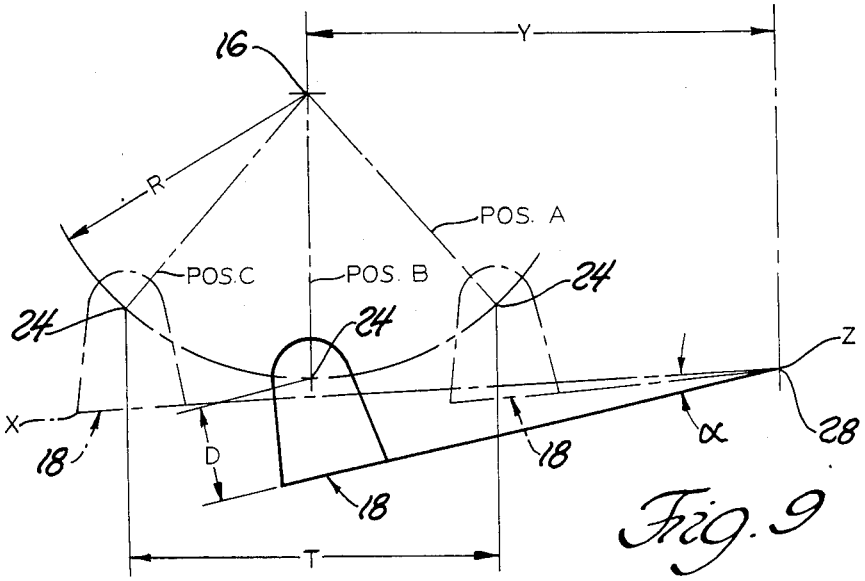
FIG. 9 is a schematic view illustrating different steering positions of the steering assembly.

FIG. 9 is a diagrammatic or schematic drawing of the steering assembly 19 shown in various positions relative to the steering axis 16 and the pivot axis 28. Position A shows the hardover port steering position. Position B is the straightforward position. Position C is the hardover starboard position. For maximum efficiency the pivot axis 28 should stay as close as possible on line X-Z which goes through the hardover position A and C. The Y dimension has to realize the tiller arm radius dimension R, the clamp member dimension D and the maximum steering travel dimension T. Dimension Y should be as long as possible to make the deflection angle alpha as small as possible.

The invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A hydraulic steering assembly to be secured to a variety of outboard propulsion units supported on a propulsion unit support structure so as to rotate the propulsion unit about a steering axis, wherein the propulsion unit includes a tiller arm, said assembly comprising: a hydraulic cylinder having a hydraulically actuated rod member extending therefrom and said hydraulic cylinder having a neutral position of actuation; securing means for rotatably securing said hydraulic cylinder to the outboard propulsion unit, said securing means having an axis of rotation parallel to the steering axis of the propulsion unit, said securing means including cylinder plate means fixed to said cylinder having a first edge extending in a direction away from said tiller arm nonparallel in relation to the tiller arm when said cylinder is in said neutral position, said securing means also including tiller plate means adapted for fixed attachment to the tiller arm; connection means for interconnecting said cylinder plate means and said tiller plate for rotation relative to one another about said axis of rotation; and pivot means adapted for attachment to the propulsion unit support structure and including a connection to said rod member which is nonrotatable about the steering axis and including attachment means for attachment through an opening along a tilt axis in the propulsion unit support structure for tilting rotation about the tilt axis which extends transversely to the steering axis so that force exerted by actuation of said hydraulic cylinder against said pivot means rotates the outboard propulsion unit about the steering axis and so that the propulsion unit may be rotated into and out of the water about the tilt axis.

2. An assembly as set forth in claim 1 wherein said tiller plate means includes a tiller plate having at least two holes therethrough for receiving fastening means for attachment to the tiller arm, said cylinder plate means being rotatably secured to the same side of said tiller plate as the tiller arm.

3. An assembly as set forth in claim 2 wherein one of said holes is elongated to allow attachment of the tiller arm to either side of said tiller plate and to allow for different distances between mounting holes.

4. An assembly as set forth in claim 3 including a second tiller plate adapted for attachment to a second tiller arm of a second outboard propulsion unit and coupling means directly coupling said tiller plates together for coordinating steering movement between two outboard propulsion units whereby forces are transferred directly between the tiller arms.

5. An assembly as set forth in claim 4 wherein said coupling means includes a tie rod, said first and second tiller plates have bores therein for receiving bolt means therethrough for rotatably securing said tie rod therebetween.

6. An assembly as set forth in claim 5 wherein said cylinder plate means includes a cylinder plate including said first edge of said cylinder plate means and having a second edge spaced therefrom, said second edge having a notch therein for allowing clearance of the end of said tie rod.

7. An assembly as set forth in claim 6 wherein said cylinder plate means includes a bushing having a bore therethrough for receiving said connection means, said bushing having a collar with a cylindrical length longer than the thickness of said cylinder plate and extending about said bore, said collar having an outer diameter, said cylinder plate having a bore therethrough for receiving said outer diameter of said collar, said connection means rotatably securing said cylinder plate between said bushing and said tiller plate for rotation therebetween about said axis of rotation.

8. An assembly as set forth in claim 7 wherein said cylinder plate means includes a clamp member having clamping means for clamping engagement about said cylinder.

9. An assembly as set forth in claim 8 wherein said clamp member is of a C-shaped construction having first and second legs disposed about said cylinder, said legs having bores therethrough for receiving fastening means for clamping said legs about said cylinder.

10. An assembly as set forth in claim 9 wherein said first leg of said C-shaped construction includes a flat surface having a plurality of bores therein, said cylinder plate having bores therein corresponding to said bores in said first leg for receiving bolting means which fixedly secure said cylinder plate to said C-shaped construction.

11. An assembly as set forth in claim 10 wherein said cylinder includes a barrel member having two ends, said cylinder also includes two gland members having coupling means for receiving hydraulic fluid therewithin, said gland members being fixedly secured to said ends of said barrel member.

12. An assembly as set forth in claim 1 wherein said securing means includes a first tiller plate adapted for attachment to the tiller arm, said assembly including a second tiller plate adapted for attachment to a second tiller arm of a second outboard propulsion unit and coupling means for directly coupling said tiller plates together for coordinating steering movement between two outboard propulsion units whereby forces are transferred directly between the tiller arms.

13. An assembly as set forth in claim 12 wherein said coupling means includes a tie rod, said first and second tiller plates having bores therein for receiving bolt means therethrough for rotatably securing said tie rod therebetween.

14. An assembly as set forth in claim 13 wherein said securing means includes a cylinder plate fixed to said cylinder and rotatably connected to said first tiller arm plate, said cylinder plate including an edge having a notch therein for allowing clearance of the end of said tie rod.

15. A propulsion unit assembly for a boat comprising: a propulsion unit having a steering axis and a tiller arm extending from said steering axis; a support structure for removably attaching said propulsion unit to the boat and defining a tilt axis for said propulsion unit; and a hydraulic steering assembly for rotating said propulsion unit about said steering axis while allowing said propulsion unit to rotate about said tilt axis of said support structure, said hydraulic steering assembly including a hydraulic cylinder having two ends and a hydraulically actuated rod member extending from each of said ends of said cylinder, securing means disposed on said cylinder in radially spaced relationship to said rod and securing said cylinder to said tiller arm of said propulsion unit for allowing relative rotation therebetween upon movement of said cylinder along said rod to rotate said propulsion unit about said steering axis and to move about said tilt axis with said propulsion unit and said cylinder, and first means attached to said support structure through said tilt axis and including a connection to said rod member which is nonrotatable about said steering axis so that force exerted by actuation of said hydraulic cylinder through said rod member and against said first means moves said hydraulic cylinder along said rod member to rotate said propulsion unit through its complete steering sweep about said steering axis.

16. An assembly as set forth in claim 15 wherein said first means includes an insertion member having an elongated portion disposed along said tilt axis and a transverse portion extending transversely from said elongated portion to said connection to said rod member.

17. An assembly as set forth in claim 16 wherein said support structure includes a tilt tube defining said tilt axis for supporting said elongated portion therein, said securing means having an axis of rotation parallel to said steering axis, said first means including pivot means supported by said tilt tube including said connection to said rod member which is nonrotatable about said steering axis so that force exerted by actuation of the hydraulic cylinder against said pivot means moves said cylinder along said rod member to rotate said propulsion unit about said steering axis and so that said propulsion unit and said hydraulic cylinder may be rotated into and out of the water about said tilt axis.

18. A hydraulic steering assembly for a propulsion unit having a steering axis and a tiller arm connected to the propulsion unit at the steering axis and for rotating a propulsion unit about a steering axis while allowing the propulsion unit to rotate about a tilt axis of a support structure, said assembly comprising: a hydraulic cylinder including two ends and having a hydraulically actuated rod member extending from both of said ends thereof; securing means disposed on said cylinder in radially spaced relationship to said rod for securing said cylinder to the tiller arm of the propulsion unit to allow relative rotation therebetween upon movement of said cylinder along said rod to rotate the propulsion unit about the steering axis and for moving said cylinder with the propulsion unit as the propulsion unit is rotated about the tilt axis; and first means for being connected to the support structure through the tilt axis and including a connection to said rod member which is nonrotatable about the steering axis and rotatable with the propulsion unit about the tilt axis so that force exerted by actuation of said hydraulic cylinder through said rod member and against said first means moves said hydraulic cylinder along said rod member to rotate the propulsion unit through its complete steering sweep about the steering axis, said cylinder and said connection rotating with the propulsion unit about the tilt axis.

19. An assembly as set forth in claim 18 wherein said first means includes a transverse portion connected to said rod member at said connection and extending transversely from said rod member.

20. An assembly as set forth in claim 19 wherein said securing means rotatably secures said hydraulic cylinder to the propulsion unit, and said first means includes a member having an elongated portion, said transverse portion extending transversely from said elongated portion to said rod member.

21. An assembly as set forth in claim 18 wherein said first means includes a member having an elongated portion and a transverse portion extending transversely from said elongated portion to said connection to said rod member.

22. An assembly as set forth in claim 21 wherein said elongated portion of said member extends axially along the tilt axis in the propulsion unit support structure which supports the propulsion unit to a boat to allow tilting rotation of the propulsion unit about the tilt axis which is transverse to the steering axis.

23. An assembly as set forth in claim 18 wherein said securing means is disposed between said ends of said cylinder.

24. An assembly as set forth in claim 18 wherein said securing means includes at least one clamp member for clamping engagement about said cylinder.

25. An assembly as set forth in claim 24 wherein said clamp member is a C-shaped construction having first and second legs disposed about said cylinder, said legs having bores therethrough for receiving fastening means for clamping said legs about said cylinder.

26. An assembly as set forth in claim 25 wherein said first leg of said C-shaped construction includes a flat surface having a plurality of bores therein, said securing means including a cylinder plate having a plurality of bores therein corresponding to said bores in said first leg for receiving bolt means to secure said cylinder plate to said C-shaped construction.

27. An assembly as set forth in claim 26 wherein said cylinder plate is adapted for connection to the propulsion unit.

28. An assembly as set forth in claim 18 wherein said securing means has an axis of rotation parallel to the steering axis of the propulsion unit, said first means including pivot means adapted for attachment to the propulsion unit support structure and including said connection to said rod member and including attachment means for attachment through an opening along a tilt axis in the propulsion unit support structure for tilting rotation about the tilt axis which extends transversely to the steering axis so that force exerted by actuation of the hydraulic cylinder against said pivot means rotates the outboard propulsion unit about the steering axis and so that the propulsion unit may be rotated into and out of the water about the tilt axis.

29. An assembly as set forth in claim 28 wherein said pivot means includes an insertion member having an elongated portion for extending through an opening along the tilt axis and rotatable about the tilt axis to allow rotation of said insertion member about the tilt axis.

30. An assembly as set forth in claim 29 wherein said pivot means includes a pivotal connection defining a pivot axis generally parallel to the steering axis, said pivot axis of said connection being spaced from and in nonintersecting relationship relative to said elongated portion extending between said elongated portion and said connection.

31. A steering accessory for a marine propulsion device comprising a first bracket adapted to be fixed relative to a boat transom, a propulsion unit including a steering arm, and means including a swivel bracket for pivotally connecting the first bracket and the propulsion unit for vertical swinging movement of the propulsion unit about a tilt axis which is substantially horizontal when the first bracket is boatmounted and which is located below the steering arm and for swinging movement of the propulsion unit about a steering axis which is generally transverse to the tilt axis, a piston rod, spaced means adapted to be located outwardly of the swivel bracket with respect to the tilt axis and supporting said piston rod so that said piston rod is retained against movement axially of the tilt axis while permitting movement of said piston rod in an arc about the tilt axis in common with vertical swinging movement of the propulsion unit, a traveling cylinder carried by said piston rod for movement therealong, means for connecting said traveling cylinder and the steering arm for applying force to the steering arm so that the steering arm swings the propulsion unit about the steering axis in response to movement of said traveling cylinder along said piston rod, and piston means on said piston rod and in said traveling cylinder for reaction therebetween so as to selectively displace said traveling cylinder along said piston rod to thereby steer the propulsion unit.

* * * * *